United States Patent [19]

Schmid

[11] 4,189,147

[45] Feb. 19, 1980

[54] RIFLE TARGET MOVING APPARATUS

[75] Inventor: August Schmid, Schwerzenbach, Switzerland

[73] Assignee: Patentverwertungs-und Finanzierungsgesellschaft Serania AG, Glarus, Switzerland

[21] Appl. No.: 848,387

[22] Filed: Nov. 4, 1977

[51] Int. Cl.[2] ..... F41J 7/02

[52] U.S. Cl. ..... 273/406

[58] Field of Search ..... 273/105.6, 105.2

[56] References Cited

U.S. PATENT DOCUMENTS

| | | | |
|---|---|---|---|
| 1,061,577 | 5/1913 | Whitney | 273/105.2 |
| 3,614,102 | 10/1971 | Nikoden | 273/105.6 |

FOREIGN PATENT DOCUMENTS

| | | | |
|---|---|---|---|
| 1009975 | 6/1957 | Fed. Rep. of Germany | 273/105.6 |
| 1057916 | 5/1959 | Fed. Rep. of Germany | 273/105.6 |
| 1129869 | 5/1962 | Fed. Rep. of Germany | 273/105.2 |
| 1200173 | 10/1963 | Fed. Rep. of Germany | 273/105.2 |

*Primary Examiner*—Richard C. Pinkham
*Assistant Examiner*—Lawrence E. Anderson
*Attorney, Agent, or Firm*—Frishauf, Holtz, Goodman, Woodward

[57] ABSTRACT

To permit conjoint tilting movement of rifle targets which are slideable on a track between a target position and an inspection position to inspect hits on the target, a guide track system is provided to guide movement of the target from the target area towards the firing area; a fixed drive gear is located at the target area to provide about ninety degree rotary movement upon engagement with the drive gear, and coupling apparatus associated with the targets conjointly coupling a plurality of targets to the drive gear when the targets are moved to the target position to swing the targets into a position presenting the targets to the rifleman, and permit rotating the targets by about ninety degrees for subsequent movement towards the firing position to permit inspection of hits by the rifleman.

13 Claims, 5 Drawing Figures

RIFLE TARGET MOVING APPARATUS

The present invention relates to an apparatus to conjointly tilt rifle targets about a vertical axis to permit ready inspection of hits on the targets.

BACKGROUND AND PRIOR ART

Targets in silhouette form used, for example, in military firing exercises should be capable of being inspected for hits on the targets rapidly by the rifleman. This requires tilting, or rotating the targets about a vertical axis within a short period of time, for example within about 2/10 seconds from an active position, presenting a target silhouette to the rifleman to an inactive position presenting only a narrow edge to the rifleman for rapid movement from the target area to the firing area. This ninety degree movement must be quick and positive. Usually, a plurality of such targets are provided and to be able to move the targets conjointly requires substantial force in order to overcome the inertia of the targets as well as wind and other resistances. The targets not only have to be twisted, or rotated from a flat target-presenting position to a moveable position but additionally must be so constructed that they then permit movement of the rotated target from the target area to the firing area where they can be inspected for hits, so that the riflemen firing on the targets can themselves inspect their firing accuracy and can prepare the targets for subsequent use, for example by pasting cover strips over holes caused by bullets fired through the targets.

THE INVENTION

It is an object to provide an apparatus for conjoint rotary movement of a plurality of targets, typically rifle targets by rotation over about ninety degrees, and in which the requirements for apparatus as well as power to drive the apparatus is substantially reduced.

Briefly, a fixed drive gear is located at the target area, preferably a star wheel or Geneva movement-type drive gear; coupling means are provided conjointly coupling the respective targets with the fixed drive gear or linkages connected thereto to permit conjoint rotary movement of the targets when the drive gear is energized.

The system permits conjoint movement of a plurality of targets at a high rate with comparatively low power requirements. The purely mechanical rotation of the targets can be carried out without shocks or sudden acceleration or deceleration. The speed of rotation changes gradually from stopped condition to a maximum and then again drops gradually to stopped position, with the target rotated by about ninety degrees. The position of the targets is accurately fixed in the pauses between operation of the drive gear, so that positional errors upon rotation of the drive gear will not be additive during subsequent movement thereof.

Drawings, illustrating an example:

Figure 1:
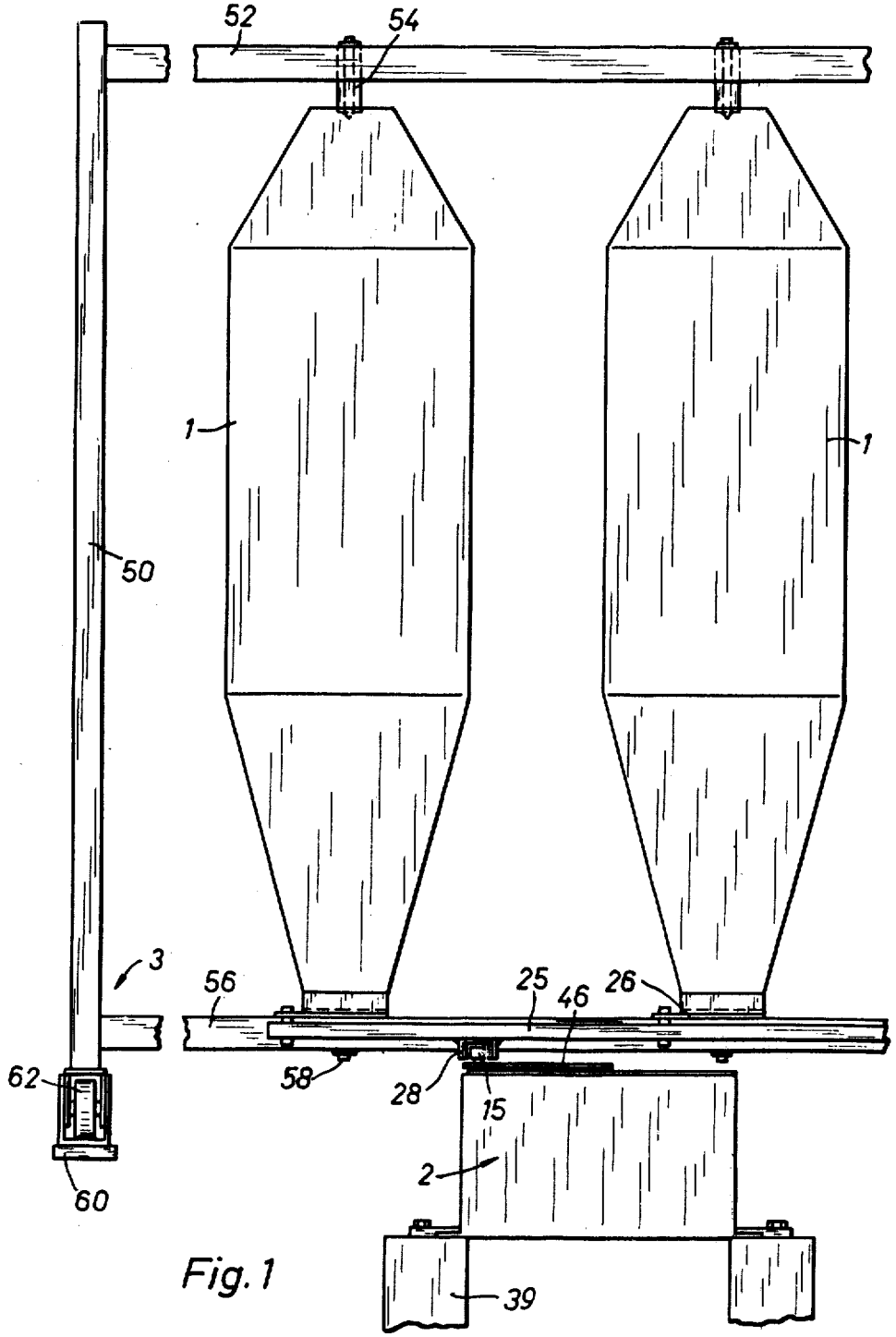
FIG. 1 shows a front view of two targets, selected for illustration, at the target position and presenting, for example, stylized silhouettes to a rifleman.

A plurality of silhouette targets 1 are located on a firing range at a target position in an aligned row. For firing exercises, the broad or flat side of the silhouettes faces the riflemen. To inspect hits on a target, the targets are to be rotated by ninety degrees with respect to the plane of the drawing of FIG. 1, so that they present their narrow edge to the riflemen and thus can be moved rapidly towards the riflemen for inspection of hits and repair of the targets if they have been hit. Rotation about ninety degrees about a vertical axis should be as rapid as possible. The targets 1 are rotated by a drive gearing 2 which is fixedly located at the target position at the bottom of the targets, for example by being secured to a fixed base structure 39. All the targets 1 are commonly mounted on a carriage 3 which is moveable on a track 64 rolling movement from the target area towards the rifleman at the firing line. The specific apparatus to maintain the targets upright and to roll the target from the target area to the firing line has been omitted since it is well known and does not form part of the present invention.

Only two targets are shown in FIG. 1 for simplicity of the drawing. In an actual installation, a much larger number of such targets 1 would be secured to the frame 3. The frame 3, moveable on a track 60 is arranged to provide for force transmitting engagement of the targets, or portions of the frame to which the targets are secured with the drive of the drive gearing 2. A funnel-shaped receiver 24 (FIG. 2) is coupled to a guide track 28, secured to the frame 3 to permit engagement of a coupling pin 15 projecting from the gear 2 with the guide rail or track 28, which forms a coupling rail coupled to a cross rod 25 (FIG. 2) connected to all the targets 1. Link arms 26 are linked to the cross rod 25. The other end of the link arms 26 are connected in rotation-transmitting connection each with one of the targets 1 so that upon movement of the cross rod 25 in the direction of arrow C (FIG. 2) the targets 1, coupled to the links 26, will be rotated about a vertical axis. The relative length of the link arms 26 and the radius of rotation of the coupling bolt or pin 15 projecting from the gearing 2 are so dimensioned that when the coupling pin 15 moves about 180°—starting from the position shown in FIG. 2—the links 26 and the targets 1 connected thereto carry out a 90° rotary movement.

Figure 2:
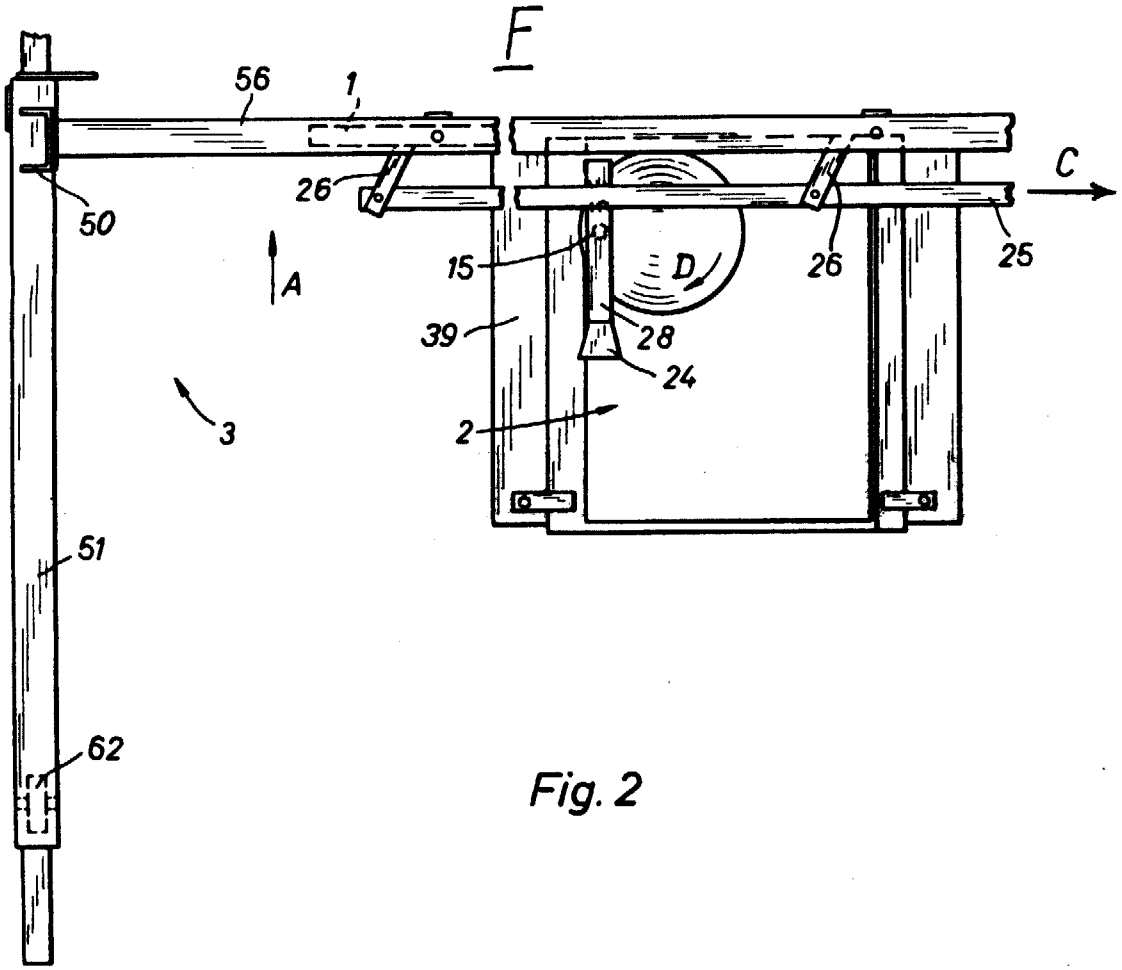
FIG. 2 is a top view on the arrangement of FIG. 1, from which the targets as such have been omitted.

FIG. 2 illustrates the targets in the target position, with the firing line being to the left (or upper side of the figure) of FIG. 2, and in the direction generally indicated by F. After firing on the targets, the carriage frame 3—on which in FIGS. 1 and 2 only the left half is shown—is moved by means of a suitable drive mechanism (not shown) on the rails 60 towards the firing line of the rifleman, in the direction of the arrow A (FIG. 2). Movement can be effected, for example, by a rope-and-pulley arrangement coupled to the frame 3 and, for example, manually operated. The pin or bolt 15 coupled to the drive gear 2 is thereby released from the guide rail or track 28. Prior to moving the targets from the target position at FIG. 2 towards the firing line, the targets are rotated from the position shown in FIG. 1 to a position twisted 90° with respect thereto, out of the plane of the paper of the drawing.

Figure 3:
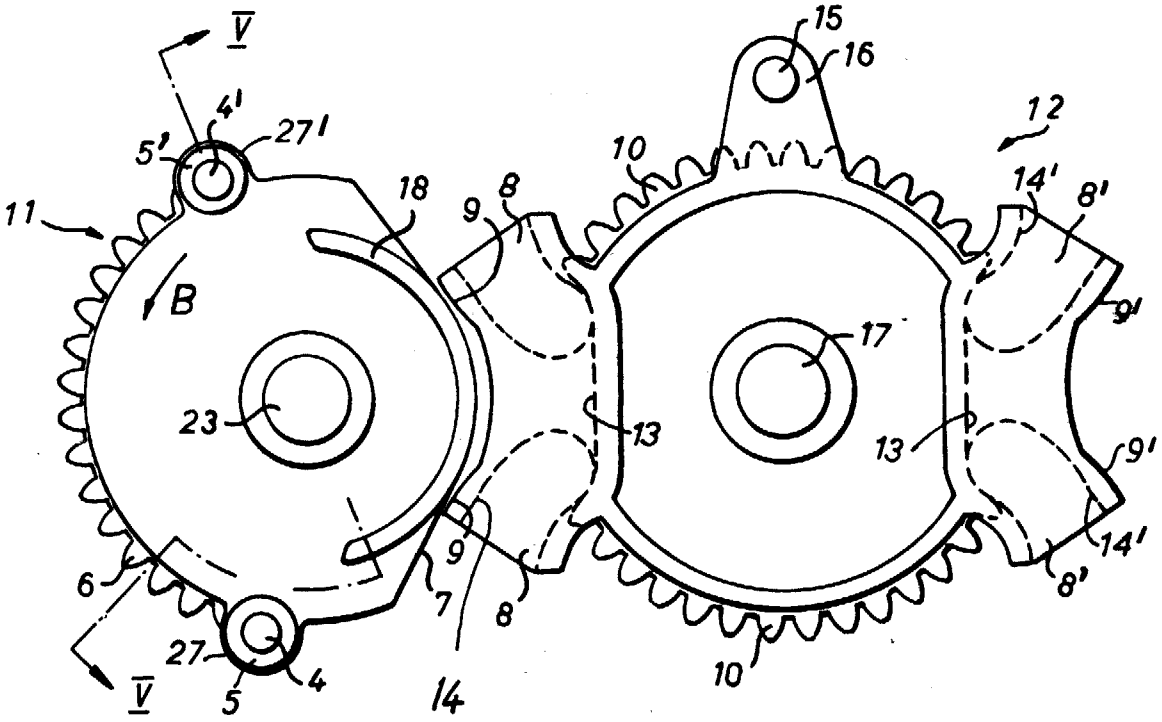
FIG. 3 is a highly schematic top view of the gearing showing a driver gear and a switching gear in a first position.
Figure 4:
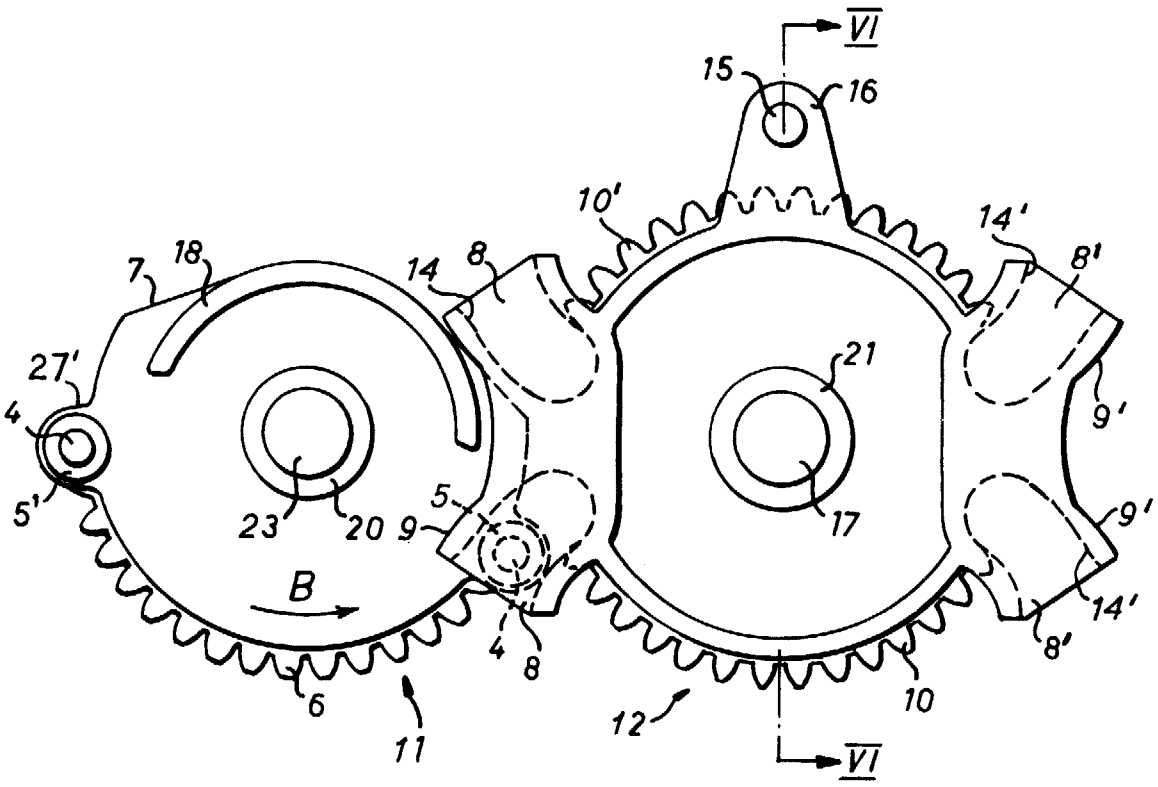
FIG. 4 is a top view of the gearing of FIG. 3 but rotated by about seventy degrees.
Figure 5:
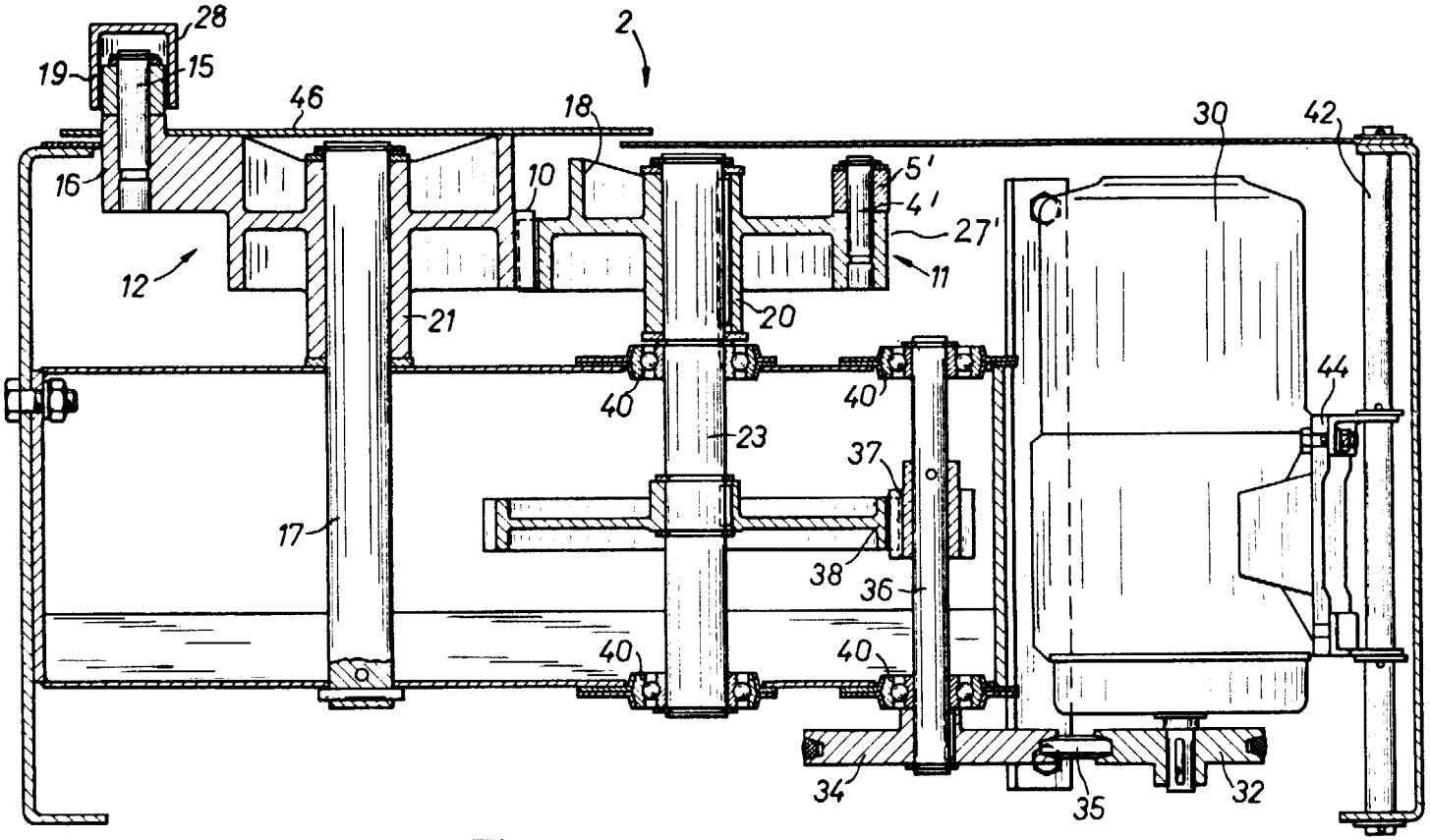
FIG. 5 is a vertical cross-sectional view along line V—V of FIG. 3, in which it is to be noted that the line V—V is partly circular at the lower portion of FIG. 3.

The drive gear 2 is shown in greater detail in FIGS. 3 to 5. The gearing is a star wheel gearing which, generally, is a type of gearing in which a driver is provided, in turn driven by a rotating motor, the driver cooperating with a driven switching wheel which carries out a controlled intermittent movement. Locking means are provided to insure positioning of the driven switching wheel in their respective rotated positions.

Motor 30 (FIG. 5) intermittently operates shaft 23, that is, is energized to drive shaft 23 when the targets are to be rotated. Shaft 23 is secured to the driver gear 11. Driver gear 11 cooperates with a switching gear 12 (FIGS. 3, 4). The driver gear 11 has a partial circumferential gearing 6, extending over less than half the circumference of the driver gear 11. The remaining portion of the circumference is formed by a gearless or tooth-less portion 7. The region diametrically opposite the gear 6, and axially offset with respect thereto (see FIG. 5) has a circular segmental rotation lock ridge 18 formed thereon, extending over less than half the circumference of the driver 11. Eyes 27, 27' are located adjacent the end regions of the gear portion 6, each one of the eyes 27, 27' securing a bolt 4, 4' on which follower rollers 5, 5' are located. The bolts 4, 4' extend parallel to the shaft 23 (see FIG. 5).

The switching gear 12, cooperating with a driver 11 is rotatably journalled on a shaft 17, extending parallel to shaft 23. Switching gear 12 has two diametrically oppositely located gear segments 10, 10', separated by gear-less recessed segmental portions 13, 13'. Receiving forks 8, 8' and open at the bottom are located in the regions of the tooth-less portions 13, 13'. The clearance widths of the respective forks 8, 8' is just slightly greater than the diameter of the follower rollers 5, 5' on the driver 11. The entry grooves 14, 14' are so positioned that upon engagement of a roller 5 into the entry portion 14, 14' and subsequent rotation of the driver, a tooth of the driver 11 will exactly fit into a tooth gap of the switching gear 12. Upon rotation of the driver in the direction of the arrow B, it will, therefore, engage the switching wheel 12 initially and, thereafter, the gear teeth 6 of the driver and the gear teeth 10 of the switching wheel will engage. The teeth 6 of the driver 11 and the teeth 10 of the switching wheel 12 have the same pitch circle. An eye 16 extends above the level of the gear teeth 10 from the switching wheel 12 in the center region of one of the teeth segments 10. The coupling pin or bolt 15 (FIGS. 1, 2) extends from the eye 16, parallel to shafts 17, 23.

As best seen in FIG. 2, the coupling pin 15 extends from the bottom into the guide rail or coupling rail 28 if a moveable carriage frame 3 is in the target position, that is, at the position shown in FIG. 2, remote from the firing line. The two forks 8, 8' are above the gear teeth 10. The outer walls of the forks 8, 8' cooperate with the locking ridge 18 of the driver 11, as best seen in FIG. 3. The housing of the forks 8, 8' is formed with two spaced locking surfaces 9, 9', one at each fork, which are positioned adjacent to and permit engagement with the segmental locking ridge 18. There is a slight spacing or play between the surfaces 9 and the locking ridge 18. When the driver is in the position of FIG. 4, and stopped, that is, in the switching intervals, the switching wheel 12 is locked and cannot rotate.

The motor 30 (FIG. 5) is located in the interior of housing 2 and suspended from a swing support 44 on a rotatable rod 42. A drive pulley 32 located on a shaft of the motor 30 drives a driven pulley 34 by means of a V-belt. Driven pulley 34 is located on a vertical shaft 36, journalled in ball bearings 40. A pinion 37 on shaft 36 engages a gear 38 which drives shaft 23, connected to the driver 11. Shaft 23 is also journalled in ball bearings 40.

The driver 11 is secured to the upper end of shaft 23, to cooperate with the switching wheel 12 as above described. The switching wheel is located at the upper portion of shaft 17 which is rotatably positioned in the housing. The shafts 17, 23, 36 are vertical and parallel with respect to each other. A cover 46 is located above the top side of the switching wheel 12. The cover 46 rotates together with the switching wheel 12. The coupling pin or bolt 15, extending upwardly from the eye 15 has a follower roller 19 secured thereto, the follower roller 19, itself engaging the guide track, or coupling track 28 which, as shown, preferably is an inverted U-channel, with the capturing funnel 24 at the free end (see FIG. 2). The entire gear box 2 is secured to a base, or socket 39 (FIGS. 1, 2).

The carriage frame 3 has a vertical frame member 50, a lower horizontal strut 56 and a upper horizontal strut 52. The frame 50 also extends laterally, preferably in a U-channel 51 extending over the track 60, the U-channel 51 (FIG. 2) receiving roller 62 which run on the horizontal track 60. Only one such roller is shown for simplicity of the drawings. The targets 1 are secured in vertical position by upper vertical bearings 54 and lower vertical bearings 58 in the respective struts 52, 56. Only the left portion of the frame carriage 3 is shown in FIGS. 1 and 2, the right portion being the mirror image thereof.

Operation: Upon energization of motor 30, driver 11 is driven from the position shown in FIG. 3 in the direction of arrow B. Initially, switching wheel 12 will remain stationary since the locking ridge 18 on driver 11, cooperating with the locking surfaces 9 on the fork elements 8 prevents rotation of the switching wheel 12. The gear portions 6, 10, are not yet engaged. Upon continued rotation of driver 11 in the direction of the arrow B, the position illustrated in FIG. 4 will be reached in which the follower 5 on the driver 11 engages the inlet 14 of the fork 8. Simultaneously, the adjacent locking surface 9 is now removed from engaging position with the ridge 18 on the driver 11. Further rotation of the driver 11 in the direction of the arrow B will cause rotation of the wheel 12. When the follower 5 has reached the innermost portion, or root of the duct formed by the fork 8, gear portions or segments 6, 10 of the drivers 11, 12 will begin to engage. Driver 11 and gear 12 will then have the same speed, if the diameters of the wheels 11, 12 are the same. The speed relationship upon engagement of the followers 5 in the channels 14, that is, upon engagement of the followers 5 with the forks 8 will be gradual and different from the positive driving engagement of the gears 6, 10, thus providing for a gradual starting of the switching wheel 12. When the respective gear segments 6, 10, reach the terminal end of their engagements, the other follower roller 5' will engage fork 8' of the switching wheel 12 and continue to rotate the switching wheel 12 until it has rotated for a half revolution, that is, over 180°. Upon completed rotation of the switching wheel by half a revolution, therefore, the positions of the wheels will be as shown in FIG. 3 with, however, the pin or bolt 15 rotated 180° with respect to that shown in FIG. 3. Termination of rotation of the switching wheel 12 will occur at a rate similar to start-up so that deceleration also is gradual. Upon release of engagement of the gear segment 6, 10, the locking ridge 18 will again be adjacent locking surfaces, this time against locking surfaces 9', 9'.

After the switching wheel 12 has rotated by 180°, the motor 30 is stopped and driver 11 thus also will stop. During a half-revolution of the switching wheel 12, the pin or bolt 15 has moved the cross bar 25 in the direction of the arrow C (FIG. 2) thus conjointly rotating all targets 1 by 90°. If the targets 1 are to be returned to their starting position, as shown in FIG. 1, a rotation by 90° of the targets will have to be effected in the reverse direction. Rotation of the driver 11, and of the switching wheel 12 will be in the same direction, however, that is, will continue in the direction of arrow D of FIG. 2. The previously described cycle will repeat. The coupling pin or bolt 15 will carry out a further half-revolution, thus returning the coupling pin 15 again to its starting position shown in FIG. 3.

Various changes and modifications may be made within the scope of the inventive concept.

I claim:

1. Apparatus for conjoint rotation of longitudinally slidable targets, positioned in an aligned row for shooting practice, and the like, comprising a guide track system (60) guiding movement of the targets (1) from a target area towards the firing area;

a drive gear (2) located at the target area and providing for about 90° rotary movement of the target;

and coupling means associated with the targets conjointly coupling a plurality of the targets with said fixed drive to provide for conjoint rotation of said targets by about 90° and permit longitudinal movement of the targets essentially parallel to their major plane, as rotated by said drive gear, said coupling means including a link arm (26) having one end thereof coupled to each one of the targets (1);

a common cross rod (25) extending essentially parallel to the row of the targets, the other ends of the coupling arms (1) being attached to said cross rod;

a driven wheel (12) driven by said drive gear (2);

a coupling pin (15) axially projecting from said driven wheel (12) and eccentrically located thereon;

and a coupling guide track or rail (28) rigidly attached to said cross rod (25) and slidably receiving said coupling pin (15), to move the cross rod and hence said link arms upon rotation of the wheel (12) and hence move the targets (1) coupled to the link arms, said coupling track or rail (28) comprising a channel element extending in the direction of movement of the targets (1) between the target area and the firing area, and having means (24) to receive the coupling pin or bolt (15) of the driven switching wheel (12) if moved in coupling direction while permitting disengaging movement of the targets in a direction opposite to said coupling direction, the coupling pin (15) being slidably guided along said channel element (28) during a rotation of the wheel (12) and swinging the targets about 90°.

2. Apparatus according to claim 1, wherein the coupling track or rail (28) is a U-shaped channel element, open to the bottom, and the means to receive the coupling pin or bolt is a funnel-shaped enlargement (24).

3. Apparatus for conjoint rotation of longitudinally slidable targets, positioned in an aligned row for shooting practice, and the like, comprising a guide track system (60) guiding movement of the targets (1) from a target area towards the firing area;

a drive gear (2) located at the target area and providing for about 90° rotary movement of the target;

and coupling means associated with the targets conjointly coupling a plurality of the targets with said fixed drive to provide for conjoint rotation of said targets by about 90° and permit longitudinal movement of the targets essentially parallel to their major plane, as rotated by said drive gear, said coupling means including a link arm (26) having one end thereof coupled to each one of the targets (1);

a common cross rod (25) extending essentially parallel to the row of the targets, the other ends of the coupling arms (1) being attached to said cross rod;

a driven wheel (12) driven by said drive gear (2);

a coupling pin (15) axially projecting from said driven wheel (12) and eccentrically located thereon;

and a coupling guide track or rail (28) rigidly attached to said cross rod (25) and slidably receiving said coupling pin (15), to move the cross rod and hence said link arms upon rotation of the wheel (12) and hence move the targets (1) coupled to the link arms;

and wherein the drive gear includes a driver wheel (11) having radially projecting engagement means (4, 5, 27) projecting from the driver wheel, said driver wheel being rotatably coupled to said drive gear (2);

the driven switching wheel (12) is formed with two engagement forks (8, 8') located diametrically opposite each other; and two segments (10, 10') are provided, located in intermediate engagement forks, each one of the engagement forks being formed with a curved inlet way (140) shaped to match and receive the engagement means (4, 5) of the driver wheel (11).

4. Apparatus for conjoint rotation of longitudinally slidable targets for riflemen, and the like, comprising a guide track system (60) guiding movement of the targets (1) from a target area towards a firing area;

a drive gear means (2) located at the target area and providing about 90° rotary movement of the targets including a turnstile or star wheel gearing, a motor rotating continuously during the 90° rotary movement of the target, a driver wheel (11) coupled to the motor and rotating therewith;

a gearing segment (6) located at portions of the circumference of the driver wheel (11);

a circular sector-shaped locking ridge (18) located on the driver wheel (11) in the region thereof (7) remote from the gearing segment (6);

radially projecting engagement means (4, 5, 27) projecting from the driver wheel (11) adjacent the ends of the gearing segment, the driven switching wheel (120) having at least one gearing segment (10, 10') having a pitch circle engageable with the gearing segment (60) of the driver wheel (11);

at least one engagement fork (8, 8') located on the driven switching wheel (12) for engagement with the engagement means (4, 5, 27) of the driver wheel (11);

and coupling means (24, 28, 25, 26) associated with the targets conjointly coupling a plurality of the targets (1) with said drive gear means (2) to provide for conjoint rotation of said targets by about 90° and permit longitudinal movement of the targets essentially parallel to their major plane, as rotated by said drive gear.

5. Apparatus according to claim 4, wherein the driven switching wheel (12) is formed with a coupling pin or bolt (15);

and the coupling means (24, 28) include a coupling track or rail engageable with said coupling pin or bolt (15), and link means (25, 26) connecting the coupling track or rail (28) to the targets (1), the link means being dimensioned to cause the targets to swing, or rotate about 90°, when the driven switching wheel (12) is rotated by 180°.

6. Apparatus according to claim 5, wherein the link means comprises a cross rod (25) secured to said coupling rail or track;

a cross strut (56) extending transversely of said targets and supporting said targets in predetermined adjacent positions; and moveable links (26) pivoted on said strut (56) and to said cross rod (25) and coupled to said targets (1) to rotate the targets about 90° upon rotary movement of said driven switching wheel.

7. Apparatus according to claim 6, wherein the coupling track or rail (28) is a U-shaped channel element, open to the bottom, and formed with a funnel-shaped enlargement (24) to receive the coupling pin or bolt (15) of the driven switching wheel (12) while permitting disengaging movement of the targets in the direction of said U-shape coupling rail or track from the coupling pin or rod.

8. Apparatus according to claim 7, wherein the driven switching wheel (12) is formed with two engagement forks (8, 8') located diametrically opposite each other, two segments (10, 10') are provided, located intermediate the engagement forks;

and wherein each one of the engagement forks is formed with a curved inlet way (14) shaped to match and receive the engagement means (4, 5) of the driver wheel (11).

9. Apparatus according to claim 4, wherein the toothless sector (7) of the driver (11) has an angular extent greater than 180° so that the circumferential extent thereof will be greater than a half circumference;

the locking ridge (18) is a circular segmental ring having an extent projecting into interfering relation with respect to the engagement fork (8, 8') to prevent rotation of the driven switching wheel when the locking ridge (18) is adjacent the engagement fork on the driven switching wheel (12) and the gear segments (6, 10) of the driven wheel (11) and of the switching wheel (12) are out of engagement.

10. Apparatus according to claim 9, wherein the engagement fork has an outer camming surface (9) positioned in interfering relationship with respect to locking ridge (18) when the gearing segments (6, 10) are out of engagement.

11. Apparatus according to claim 9, wherein the driven switching wheel (12) is formed with two engagement forks (8, 8') located diametrically opposite each other, two segments (10, 10') are provided, located intermediate the engagement forks;

and wherein each one of the engagement forks is formed with a curved inlet way (14) shaped to match and receive the engagement means (4, 5) of the driver wheel (11).

12. Apparatus according to claim 9, wherein the locking ridge (18) and the engagement forks are axially offset with respect to the gear segments (6, 10) on the respective wheels (11, 12).

13. Apparatus according to claim 9, wherein the gear segment (6) of the driver (11) and the gear segments (10) of the switching wheel (12) have the same pitch circle.

* * * * *